US005778498A

United States Patent [19]

Laks

[11] Patent Number: 5,778,498

[45] Date of Patent: Jul. 14, 1998

[54] RELEASABLE FASTENER FOR FOOT APPAREL

[76] Inventor: David A. Laks, 930 Osborne, Vista, Calif. 92084

[21] Appl. No.: 699,127

[22] Filed: Aug. 16, 1996

[51] Int. Cl.[6] ..... A44B 11/00; A43C 11/00

[52] U.S. Cl. ..... 24/625; 24/712.1; 24/714; 24/615

[58] Field of Search ..... 24/625, 615, 616, 24/634, 712.1, 713.6, 713.9, 714, 714.8; 411/338, 339; 36/50.1

[56] References Cited

U.S. PATENT DOCUMENTS

| | | | |
|---|---|---|---|
| D. 323,576 | 2/1992 | Laks | 314/275 |
| 1,084,850 | 1/1914 | Ford | 411/338 |
| 1,105,541 | 7/1914 | Taketoshi | 24/714 |
| 1,361,645 | 12/1920 | Tomchin | 24/625 |
| 3,139,661 | 7/1964 | Sixty, Sr. | 24/615 |
| 3,600,917 | 8/1971 | Krock | 24/615 |
| 3,979,934 | 9/1976 | Isenmann | 24/615 |
| 4,907,352 | 3/1990 | Ginsberg | 36/50.1 |
| 5,222,279 | 6/1993 | Frano et al. | 24/625 |
| 5,572,774 | 11/1996 | Duren | 24/714.8 |

FOREIGN PATENT DOCUMENTS

| | | | |
|---|---|---|---|
| 0054799 | 8/1912 | Austria | 24/713.6 |
| 1323485 | 2/1963 | France | 24/713.9 |
| 6133809 | 5/1994 | Japan | 24/15 |
| 0028847 | of 1905 | United Kingdom | 24/713.9 |
| 2157759 | 10/1985 | United Kingdom | 24/634 |

*Primary Examiner*—Victor N. Sakran
*Attorney, Agent, or Firm*—Anna M. Vradenburgh; Gregory A. Piccionelli

[57] ABSTRACT

A latching mechanism for securing foot apparel to a user's foot. The latching mechanism comprises a first connecting member, a second connecting member, wherein the first connecting member is capable of mating, or interlocking, with the second connecting member. The first connecting member includes a receiving head having an aperture, and an arm, wherein the arm is adjacent the receiving head and the second connecting member includes a locking tongue and an arm, wherein the arm is adjacent the locking tongue. In some preferred embodiments, the first connecting member and second connecting member include a fastener element. The arm of the first connecting member and the arm of the second connecting member further includes an aperture that is capable of receiving a securing mechanism. Some preferred embodiments of the instant invention also include a button element having a stem, wherein the aperture of the receiving head of the first connecting element is capable of receiving the stem of the button.

15 Claims, 13 Drawing Sheets

RELEASABLE FASTENER FOR FOOT APPAREL

FIELD OF THE INVENTION

This invention is directed toward an apparatus for comfortably securing foot apparel to a user's foot without the necessity of securing the foot apparel to the user's foot with conventional laces.

BACKGROUND OF THE INVENTION

Recreational shoes, such as tennis shoes, are becoming increasingly more popular as society becomes more relaxed and less formal in its interactions. Indeed, it is not surprising to find many company personnel dressed in tennis shoes while at work as opposed to the more traditional formal shoes, such as men's dress shoes or women's high heels.

In general, young children, overweight or elderly people find it inconvenient, or difficult, to bend over and tie their shoes. Thus, efforts have been made to transform the recreational shoe into a "loafer" wherein the user need not tie the shoe with a conventional shoe lace, but rather, can simply slip the shoe onto their foot or quickly secure the shoes with a single snap.

U.S. Pat. No. Des. 323,576 ('576) to Laks shows an adjustable latch having a sawtooth mating structure for closing a shoe, wherein the latch attaches to the shoe via hooking elements. In this design, the hooking elements attach to the eyelets of the shoe. This design can present various problems. For instance, the hooking elements are not relatively flush with the underside of the eyelets and thus, press down against the user's foot and cause discomfort to the user. This problem occurs because the hooking elements, which are somewhat bulky in nature, protrude below the eyelet and are drawn close to the foot when the latch is buckled to secure the foot apparel onto the foot. Further, the sawtooth design creates a more difficult closure and release of the latch, especially for persons with limited dexterity, such as, aged persons and young children.

As seen from above, current attempts at creating a tie-less shoe have resulted in a diminishment of the comfort of the shoe. Thus, a need exists in the market to create an apparatus to allow the tie on the shoe to be circumvented, but not detract from the comfort of the recreational shoe.

SUMMARY OF THE DISCLOSURE

An object of embodiments of the present invention is to provide a latching mechanism for use with foot apparel that offers the efficiency of a lace tie.

A further object of embodiments of the present invention is to provide a tie-less, but comfortable apparatus for use with shoes, such as, but not limited to, tennis shoes.

Another object of embodiments of the present invention is to provide an apparatus that is simple to use for persons of all ages and health conditions.

Another further object of embodiments of the present invention is to provide an apparatus that allows the user to advertise personal preferences, such as, but not limited to, product preferences and promotional items.

Preferred embodiments of the present invention include a latching element having a first connecting member and a second connecting member, wherein the first connecting member is capable of mating, or interlocking, with the second connecting member. In one preferred embodiment, the first connecting member includes a receiving head and a mounting arm, wherein the mounting arm is adjacent the receiving head. The second connecting member includes a locking tongue and a mounting arm, wherein the mounting arm is adjacent the locking tongue. In other preferred embodiments, the first connecting member and second connecting member include a fastener element and a mounting arm, wherein the mounting arm is adjacent the fastener element. The mounting arm of the first connecting member and the mounting arm of the second connecting member further includes an aperture that is capable of receiving a securing member, such as a screw, binder post, or rivet.

Preferred embodiments of the instant invention also include a button element having a stem or guide member. In some preferred embodiments, the receiving head of the first connecting element includes an aperture that is capable of receiving the stem or guide member of the button.

BRIEF DESCRIPTION OF THE DRAWINGS

The detailed description of embodiments of the invention will be made with reference to the accompanying drawings, wherein like numerals designate corresponding parts in the figures.

DETAILED DESCRIPTION OF THE PREFERRED EMBODIMENTS

Figure 1A:
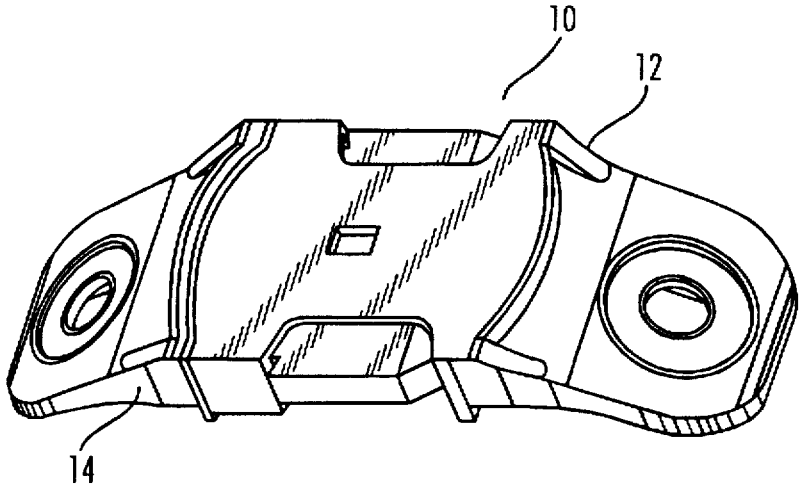
FIG. 1*a* is a top perspective view of a releasable fastener according to a preferred embodiment of present invention, wherein the latching element is in a locked, or closed, position.
Figure 1B:
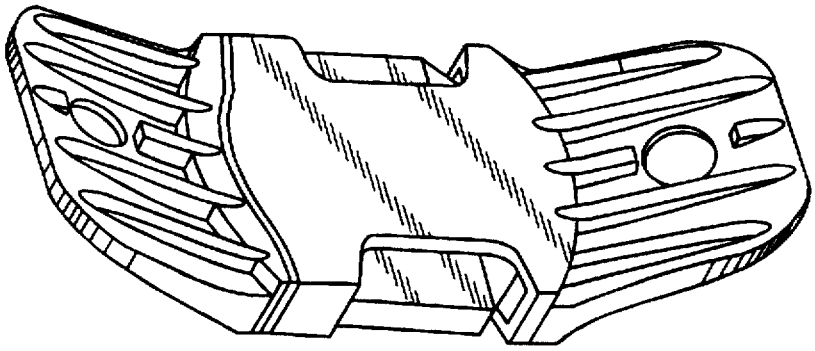
FIG. 1*b* is a bottom perspective view of the releasable fastener depicted in FIG. 1*a*.
Figure 2:
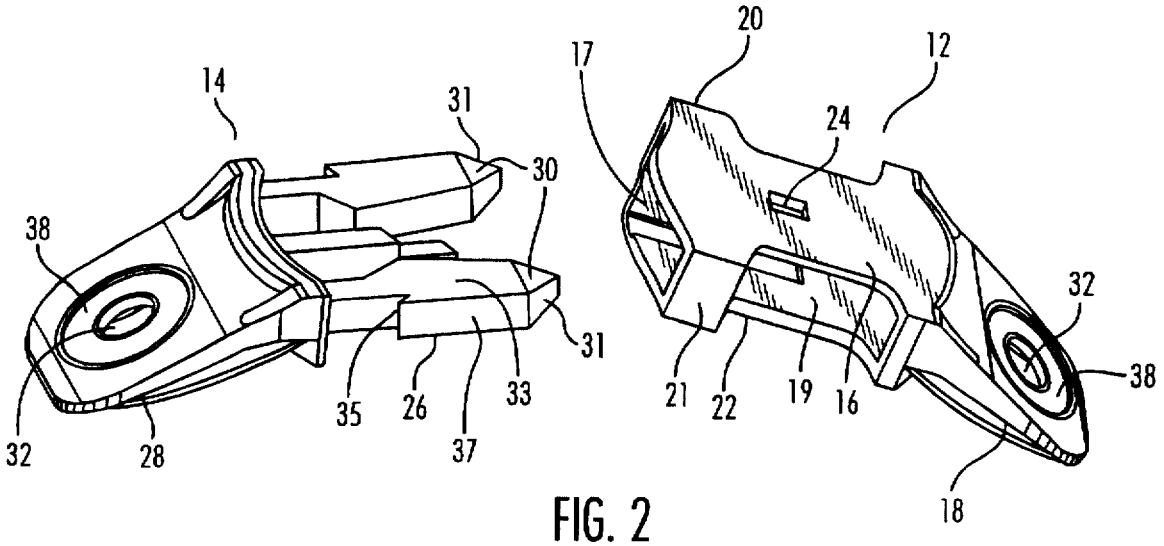
FIG. 2 is a top perspective view of a first connecting member and a second connecting member of the preferred embodiment of FIG. 1 in the unlocked or open position.

FIGS. 1*a* and 1*b* depict a preferred embodiment of a latching mechanism. The latching mechanism 10 shown in FIG. 1*a* comprises a first connecting member 12 and a second connecting member 14, wherein the first connecting member 12 and the second connecting member 14 are capable of mating, or interlocking, such that the latching mechanism 10 resides in a closed position. FIGS. 1*a* and 1*b* depict top and bottom perspective views of a preferred embodiment of a latching mechanism in the locked, or closed, position. FIG. 2 depicts the first connecting member 12 and the second connecting member 14 in an unlocked position. The latching mechanism 10 is generally made from hard plastics, but other sturdy materials, such as, but not limited to, plexiglass, or soft alloys, such as for example, aluminum are also suitable.

As shown in FIG. 2, the first connecting member 12 comprises a hollow receiving head 16 and a first mounting arm 18, wherein the first mounting arm 18 is adjacent to and extends from the head 16. The first mounting arm 18 resides at an angle relative to the horizontal plane of the receiving head 16. Preferably, the head 16 and the first mounting arm 18 are formed as a single, unitary piece. In other preferred embodiments, the head 16 and the first mounting arm 18 are formed as separate pieces, wherein the first mounting arm 18 is coupled to the head 16 by, for example, glue or soldering.

The head 16 of the first connecting member 12 has an open end 17, side openings 19, a top side 20 and a bottom side 22, wherein the top side 20 includes an aperture 24. In other preferred embodiments, the top side 20 of the head 16 does not include the aperture 24, but rather, is a solid surface.

The second connecting member 14 comprises a tongue member 26 and a second mounting arm 28, wherein the second mounting arm 28 is adjacent to and extends from the tongue 26. The second mounting arm 28 resides at an angle relative to the horizontal plane of the tongue 26. Preferably, the tongue 26 and the second mounting arm 28 are formed as a single, unitary piece. In other preferred embodiments, the tongue 26 and the second mounting arm 28 are formed as separate elements, wherein the second mounting arm 28 is coupled to the tongue 26 by, for example, glue or soldering.

In the preferred embodiments illustrated in FIGS. 1*a*–4*b*, the tongue 26 of the second connecting member 14 is configured to fit through the open end 17 of the head 16. The tongue 26 includes a pair of prong members 30, wherein each prong member 30 has a tapered end 31 and a widened end 33. The pair of prong members 30 are received in the open end 17 of the hollow receiving head 16. As the tongue enters the open end 17 of the receiving head 16, the prong members 30 flex toward each other. The tapered ends 31 of the prong members 30 abut side walls 21 of the receiving head 16 and cause the prong members 30 to resiliently flex toward each other. Once the tongue 26 is sufficiently within the receiving head 16, the widened ends 33 of the prong members 30 align with the side openings 19 of the receiving head 16, thus allowing the prong members 30 to spring back away from each other by their own resiliency. The widened ends 33 of the arms include angled surfaces 35 defining a catch or hook for abutting the edge of the side wall 21 to inhibit movement of the tongue out of the head 16. The widened ends 33 of the prong members 30 define side surfaces which can be pressed toward each other, e.g., by the user's thumb and forefinger, to flex the prong members 30 toward each other and release the catch or hook 35.

Figure 3:
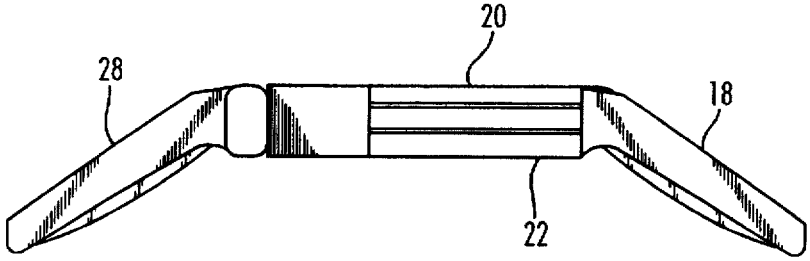
FIG. 3 is a lateral view of the preferred embodiment of FIG. 1, wherein the latching element is in a locked, or closed, position.

The receipt of the tongue 26 into the receiving head 16 releasably couples the first connecting member 12 and the second connecting member 14. When the tongue 26 is releasably coupled to the head 16, the latching mechanism 10 is in the closed or locked position, as shown in FIGS. 1*a* and 3. In other preferred embodiments, the tongue member 26 has a single prong element 30 which is received by the hollow receiving head 16.

Figure 4A:
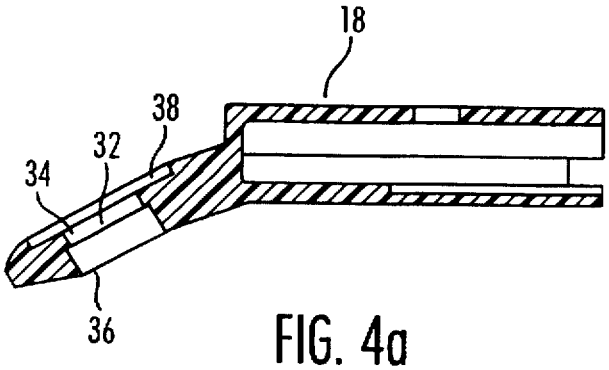
FIG. 4*a* is a lateral cross sectional view of a first connecting member of a preferred embodiment of the instant invention.
Figure 4B:
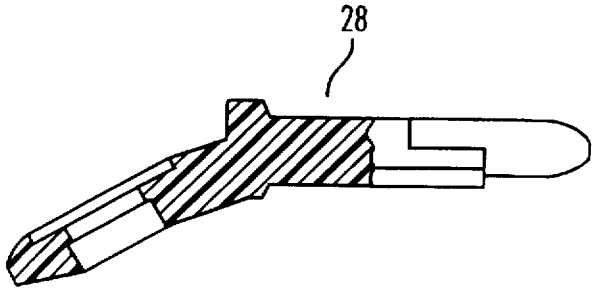
FIG. 4*b* is a lateral cross sectional view of a second connecting member of a preferred embodiment of the instant invention.
Figure 5A:
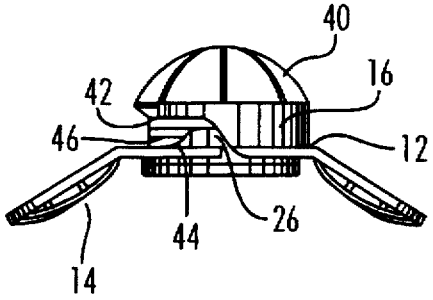
FIGS. 5*a* and 5*b* are lateral views of another preferred embodiment, including a button, of the instant invention in a locked position.
Figure 5B:
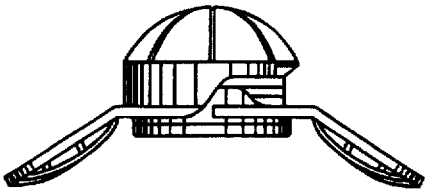
Figure 5C:
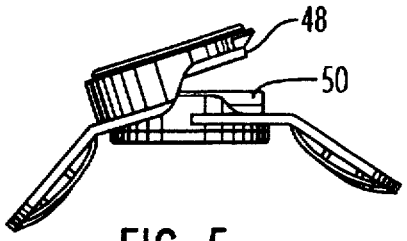
FIG. 5*c* is a lateral view of the preferred embodiment depicted in FIG. 5*a* in an open position.
Figure 5D:
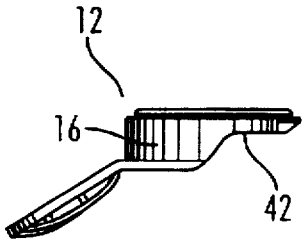
FIG. 5*d* is a lateral view of the first connecting member of the preferred embodiment depicted in FIG. 5*a* without the button.
Figure 5E:
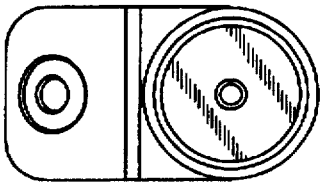
FIG. 5*e* is a top view of the first connecting member in FIG. 5*d*.
Figure 5F:
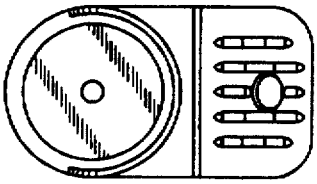
FIG. 5*f* is a bottom view of the first connecting member in FIG. 5*d*.
Figure 5G:
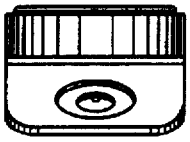
FIG. 5*g* is a frontal perspective of the first connecting member in FIG. 5*d*.
Figure 5H:
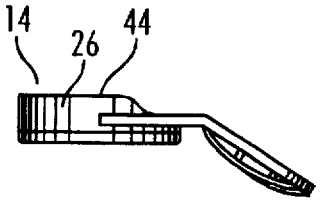
FIG. 5*h* is a lateral view of the second connecting member of the preferred embodiment depicted in FIG. 5*a* without the button.
Figure 5I:
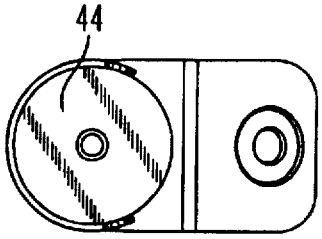
FIG. 5*i* is a top view of the second connecting member in FIG. 5*h*.
Figure 5J:
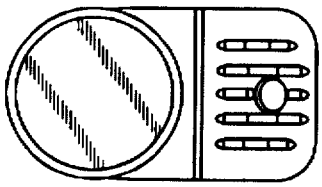
FIG. 5*j* is a bottom view of the second connecting member in FIG. 5*h*.
Figure 5K:
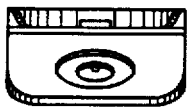
FIG. 5*k* is a frontal perspective of the second connecting member in FIG. 5*h*.
Figure 5L:
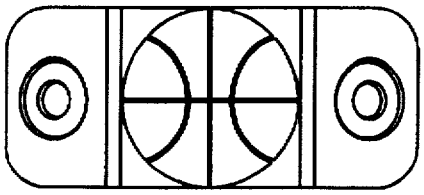
FIG. 5*l* and 5*m* are top views of the preferred embodiment depicted in FIG. 5*a*.
Figure 5M:
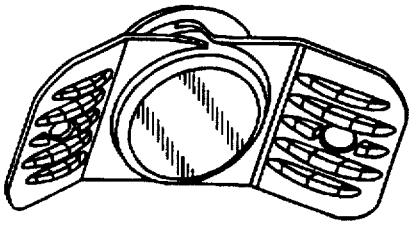
Figure 5N:
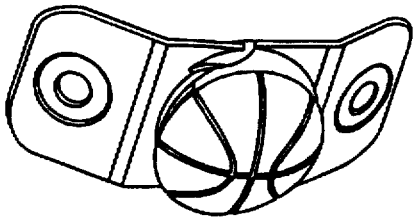
FIG. 5*n* is a bottom view of the preferred embodiment depicted in FIG. 5*a*.
Figure 5O:
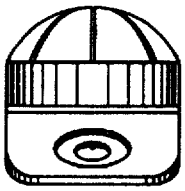
FIG. 5*o* is a frontal perspective view of the preferred embodiment depicted in FIG. 5*a*.
Figure 6A:
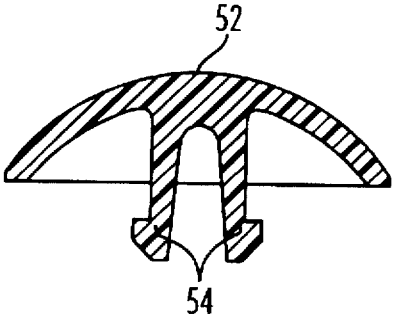
FIG. 6*a* is a cross sectional side view of a preferred embodiment of a button element having a plurality of stems or guides.
Figure 6B:
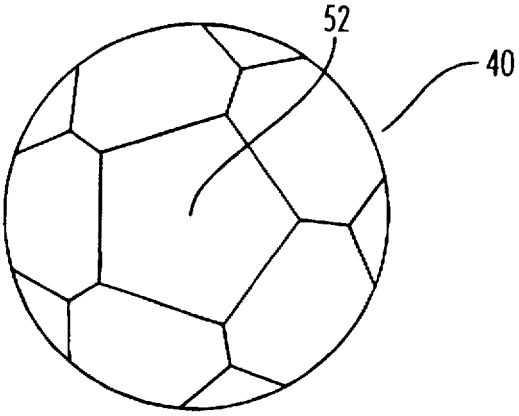
FIG. 6*b* is a top view of a preferred embodiment of the button element of FIG. 6*a*.
Figure 6C:
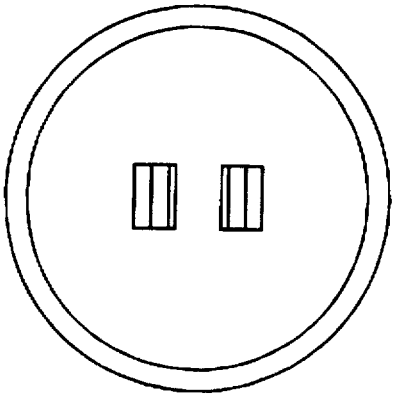
FIG. 6*c* is a bottom view of a preferred embodiment of the button element of FIG. 6*a*.
Figure 6D:
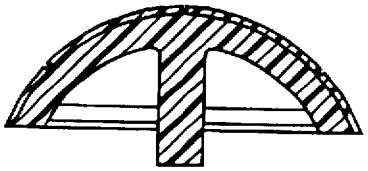
FIG. 6*d* is a cross sectional side view of another preferred embodiment of a button element having a single stem or guide.
Figure 6E:
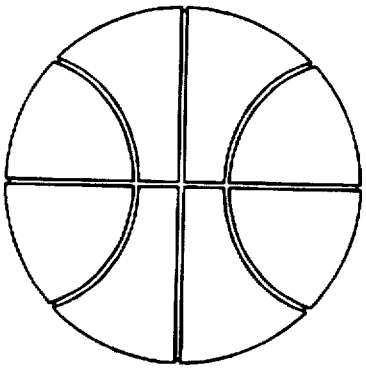
FIG. 6*e* is a top view of a preferred embodiment of the button element of FIG. 6*d*.
Figure 6F:
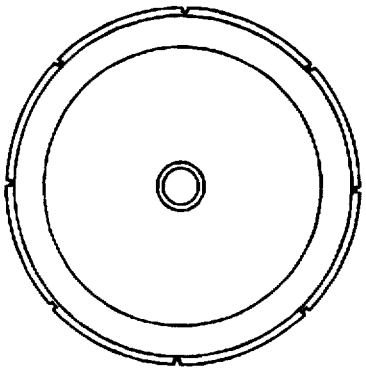
FIG. 6*f* is a bottom view of a preferred embodiment of the button element of FIG. 6*d*.
Figure 6G:
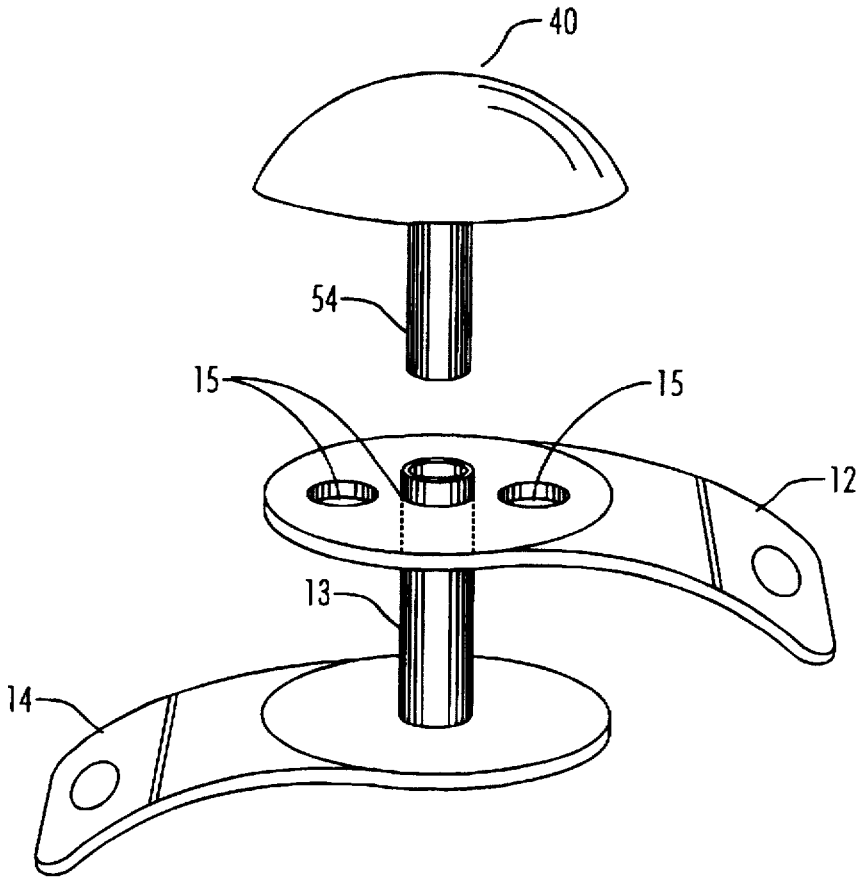
FIG. 6*g* is a side view of another preferred embodiment wherein the button element couples to the first connecting member and the second connecting member such that the latching mechanism is in the closed position.

FIGS. 4*a* and 4*b* depict cross sections of the first mounting arm 18 and the second mounting arm 28, respectively. As shown in FIGS. 4*a* and 4*b*, the first mounting arm 18 and the second mounting arm 28 include a circular recess 38 of a first diameter and an aperture 32 of a second, smaller diameter centered in the circular recess 38 capable of receiving a securing mechanism, for example, a securing element and a corresponding locking element as described below. The aperture 32 comprises a first end 34 and a second end 36. The recess 38 is disposed adjacent the first end 34 of the aperture 32. As shown in FIGS. 4*a* and 4*b*, the cross-sectional diameter of the aperture 38 is larger than the cross-sectional diameter of the first end 34 or the diameter of the second end 36 of the aperture 32. Preferably, the diameter of the recess 38 is large enough to seat for example, the head of a screw, binder post, or other securing element. In other preferred embodiments, the aperture 32 does not include a recess 38.

Figure 7:
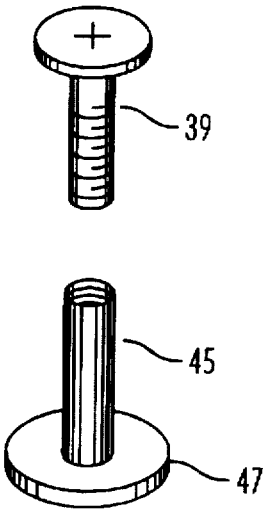
FIG. 7 depicts a preferred embodiment of a securing element and a locking element.

In preferred embodiments, the securing element 39 is a threaded member, such as, but not limited, to a screw or binder post, and the locking element is a hollow threaded receptacle 45 having a nearly flat head or flange 47 at one end (see FIG. 7). In other preferred embodiments, the securing element 39 can be any element suitable for securing the mounting arm to the foot apparel, such as, but not limited to, rivets. The receptacle 45 is capable of receiving the securing element 39 such that the securing element 39 and the receptacle 45 are coupled. However, further embodiments employ any suitable type of securing mechanisms capable of coupling the arm to the foot apparel. The securing mechanism can be easily uncoupled by the user such that the latching mechanism 10 can be interchanged with other foot apparel.

The aperture 32 is capable of communicating with the eyelet of the user's foot apparel. Preferably, the aperture is generally circular in shape, but other shapes that can accommodate a securing mechanism are also suitable.

Figure 9:
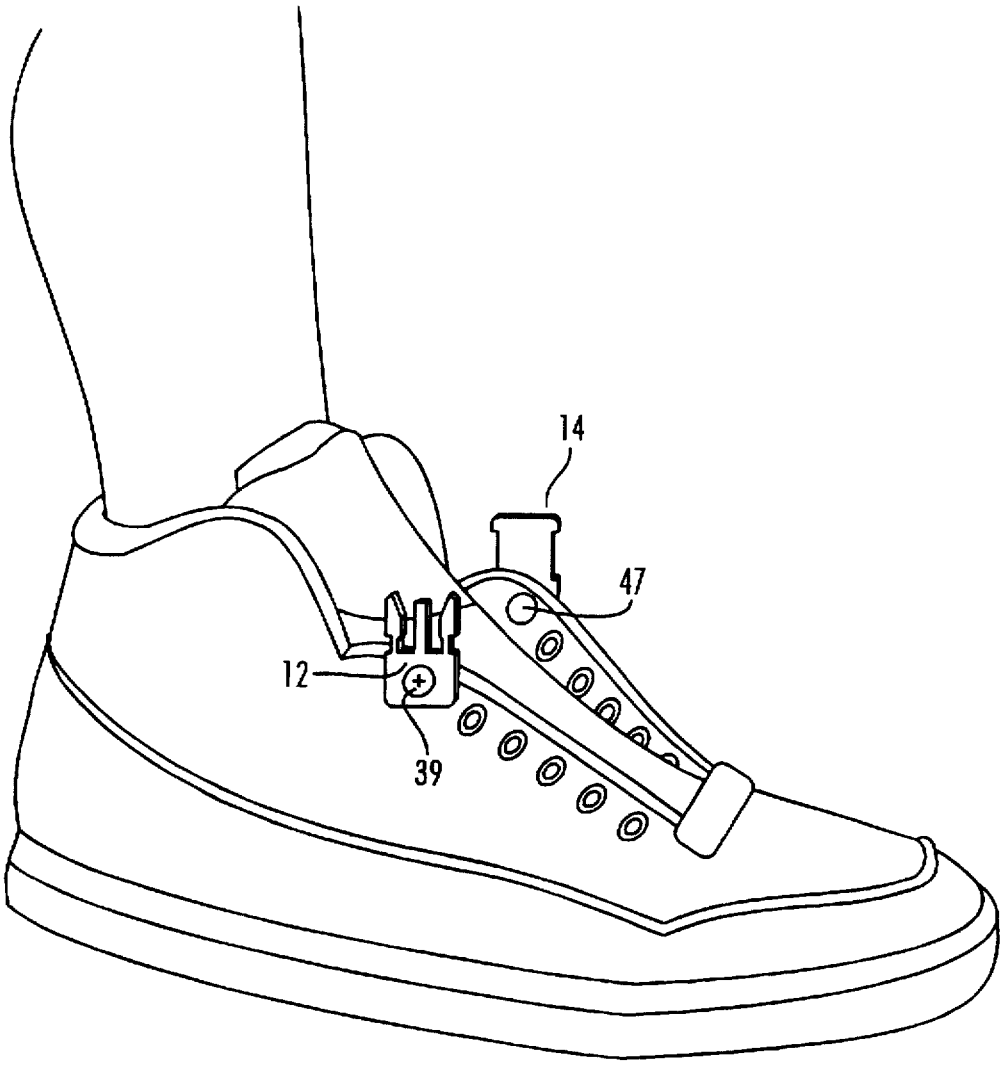
FIG. 9 depicts a first arm and a second arm secured to the upper flaps of a foot apparel.

The aperture 32 is large enough to accommodate the diameter of the hollow threaded receptacle 45 as shown in FIG. 7. The hollow threaded receptacle is pushed through the underside of the eyelet and the aperture 32 such that the flange 47 is nearly flush with the eyelet. (See FIG. 9) When locked in place, the head of the securing element 39, such as a screw, resides in the recess 38 and the flange 47 of the locking element 45 is nearer the leading edge of the body of the screw, i.e., the portion furthest from the head of the screw. Due to the flange 47 being relatively flush with the underside of the eyelet, the securing element 39 does not press against the user's foot and cause discomfort.

As shown in FIG. 3, the first mounting arm 18 and the second mounting arm 28 extend at an angle to the horizontal plane of the head 16 and the tongue 26, respectively. The first mounting arm 18 and second 28 arm are rigid in structure such that locking the latching mechanism 10 does not substantially affect the angle of the arms 18,28 relative to the head 16 and tongue 26. Due to the rigidity of the arms 18, 28, when the latching mechanism 10 is secured to the foot apparel through the eyelets, the latching mechanism 10 does not rest against the user's foot in either the open or closed position. Instead, the arms 18, 28 substantially contour the latching mechanism to the shape of the user's foot slightly above the foot apparel.

FIGS. *5a–5o* depict another preferred embodiment of the latching mechanism 10, including a button element 40. The embodiment shown in FIG. *5a* includes a first connecting member 12 having a first receiving platform 42, a second connecting member 14 having a second receiving platform 44 and a fastener element 46. In this preferred embodiment, the tongue 26 of the second connecting member 14 is disk shaped, although other shapes that will fit within the head 16 of the first connecting member 12 are also suitable.

Figure 8:
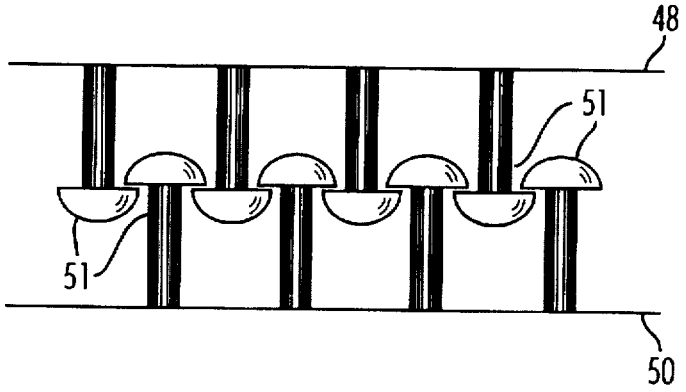
FIG. 8 (PRIOR ART)
FIG. 8 depicts a mushroom-shaped stem prior art fastener mechanism.

A preferred embodiment of a fastener element 46 is shown in FIG. 8. In this embodiment, the fastener element 46 further includes a first portion 48 and a second portion 50, wherein the first portion 48 and the second portion 50 each include a plurality of mushroom-shaped stems 51. The mushroom-shaped stems 51 provide improved tensile strength and holding power in comparison to the well known hook and loop fasteners, although a hook and look fastner is used in other preferred embodiments. The first portion 48 and the second portion 50 are capable of being coupled to each other and separated from each other, repeatedly. To couple the first portion 48 and the second portion 50, the mushroom shaped stems on each portion interlock with each other. Preferably, the fastener element 46 is made from flexible material, such as, but not limited to, rubber or plastic. In one preferred embodiment, the fastener element 46 is a Dual Lock Reclosable Fastener made by Minnesota Mining & Manufacturing (3M).

The first portion 48 of the fastener element 46 is disposed on the first receiving platform 42 of the first connecting member 12 and the second portion 50 is disposed on the second receiving platform 44 of the second connecting member 14. When the first portion 48 couples with the second portion 50, the first connecting member 12 and the second connecting member 14 are thereby coupled, and the latching mechanism 10 resides in a closed position. (See FIG. *5a*) The first portion 48 and second portion 50 can be disposed on the first receiving platform 42 and the second receiving platform 44 respectively, by any means, including, but not limited to, an adhesive backing, sewing, stapling or ultrasonic bonding. Alternatively, the first portion 48 and the second portion 50 can be formed integrally with the first receiving platform 42 and the second receiving platform 44, respectively.

FIG. *5c* depicts this preferred embodiment in an open position. As seen from the figure, the first portion 48 and the second portion 50 are pulled away from each other such that the first connecting member 12 and the second connecting member 14 separate, and thereby open the latching mechanism 10.

FIG. *6a* depicts a cross section of a button member 40 having a face 52, a bottom 53 and a plurality of stems or guides 54. In other preferred embodiments, there is a single stem or guide 54. FIG. *6b* depicts a top view of the face 52 of the button 40. The face 52 of the button 40 is capable of displaying designs, logos or other advertising indicia, such as, but not limited to, sports or product preferences. A plastic or paper member having a printed logo or design is applied to the face 52 of the button 40 by any securing means, such as, for example, glue or tape. In other preferred embodiments, the plastic or paper member having a logo is not attached to the face 52 of the button 40, but rather, the logo is for example, etched, blazed or glued onto the face 52 of the button 40 or the head 16 itself. Preferably, the button face 52 is circular in shape, but other shapes, such as, but not limited to, shapes corresponding to footballs, baseballs, and golf balls, are also suitable.

The stem or guide 54 of the button 40 is received by the aperture 24 in the head 16 of the first connecting member 12 such that the face 52 of the button 40 is visible from the top 20 of the head 16. In other preferred embodiments, a coupling means, such as but not limited to, adhesive, is disposed on the bottom 53 of the button 40. In these embodiments, when the guide 54 is received by the aperture 24, the adhesive couples the button 40 to the head 16. Logos or advertisements that are placed on the face 52 of the button 40 can then be displayed.

In other preferred embodiments, the guide 54 is a threaded member such that the button 40 screws or threads into the aperture 24 in the head 16 of the first connecting member 12. In further preferred embodiments, the button 40 does not include a guide 54. Rather, adhesive or any other suitable coupling means is disposed on the bottom 53 of the button 40 such that the button 40 is capable of coupling to the head 16 of the button 40. In still other preferred embodiments, the button 40 is capable of coupling to the head 16 of the first connecting member 12 and the tongue 26 of the second connecting member 14 such that the button 40 couples the first connecting member 12 and the second connecting member 14 to close the latching mechanism 10. As shown in FIG. *6g*, in these embodiments, the second connecting member further includes a threaded tubular receptacle 13 and the first connecting member 12 further includes a plurality of apertures 15. The threaded tubular receptacle 13 is received by at least one of the apertures 15 in the first connecting member 12. The guide 54 of the button 40 is capable of coupling with the threaded tubular receptacle 13 such that the first connecting member 12 and the second connecting member 14 are coupled.

In operation, the mounting arm 18 of the first connecting member 12 and the mounting arm 28 of the second connecting member 14 are attached to an eyelet of the user's foot apparel such that the arms 18,28 reside on top of the outer flaps 56 of the foot apparel. (See FIG. 9) A securing element, such as, but not limited to, a screw, rivet or binding post is driven through the first end 34 of the aperture 32 and then through the eyelet of the foot apparel The locking mechanism 45 is then driven through the underside of the upper flap of the foot apparel such that the flange resides relatively flush with the upper flap. The locking mechanism 45 is then threaded onto the screw. Once both arms 18,28 are coupled to the eyelets of the foot apparel, the first connecting element 12 and the second connecting element 14 are connected such that the shoe closes.

Although the foregoing described the invention with preferred embodiments, this is not intended to limit the invention. Rather, the foregoing is intended to cover all modifications and alternative constructions falling within the spirit and scope of the invention as expressed in the appended claims.

What is claimed is:

1. A latching mechanism for securing foot apparel to a user's foot, wherein the foot apparel includes upper flaps having a plurality of eyelets, comprising:

a first connecting member, including a first arm;

a second connecting member, including a second arm and capable of coupling to the first connecting member; wherein each of the first and second arms includes an aperture;

a first securing mechanism for passing through the apertures in the first arm and an eyelet of the upper flaps and a second securing mechanism for passing through the apertures in the second arm and an eyelet of the upper flaps, for coupling the first arm and second arm to the foot apparel, wherein each securing mechanism each further comprises:

a threaded member having a head, and a hollow threaded receptacle separable from the arm, the receptacle having a flange defining a generally flat surface which abuts relatively flush with the upper flap of the foot apparel coupling the arm to the foot apparel, capable of receiving the threaded member within the hollow receptacle.

2. A latching mechanism as claimed in claim 1, wherein the aperture in each of the first and second arms further includes a recess configured to receive the head of the threaded member.

3. A latching mechanism as claimed in claim 1, wherein the second connecting member further includes a tongue; and wherein the first connecting member further includes a hollow head, capable of receiving the tongue of the second connecting member.

4. A latching mechanism as claimed in claim 1, wherein the first arm extends at an angle adjacent the head and the second arm extends at an angle adjacent the tongue.

5. A latching mechanism as claimed in claim 1, wherein the second connecting member further includes a second receiving platform, and wherein the first connecting member further includes a first receiving platform; wherein the latching mechanism further comprises a fastener, including a first portion and a second portion, wherein the first portion is disposed on the first receiving platform, and wherein the second portion is disposed on the second receiving surface, the first portion and the second portion capable of releasably coupling to each other.

6. A latching mechanism as claimed in claim 5 wherein the first portion and the second portion include a plurality of mushroom-shaped stems, wherein the mushroom-shaped stems of the first portion are capable of interlocking with the mushroom-shaped stems of the second portion.

7. A latching mechanism as claimed in claim 1 further comprising:

a button member having a face and a stem, wherein the button member couples to the head of the first connecting member.

8. A latching mechanism as claimed in claim 1 further comprising:

a button member having a face and a stem, wherein the button member couples the first connecting member and the second connecting member such that the latching mechanism is closed.

9. The latching mechanism as claimed in claim 8 wherein the face defines a surface having a configuration of one of a basketball, golfball, soccerball, volleyball or baseball.

10. Foot apparel and latch for use on a user's foot, comprising:

a receptacle for receiving the user's foot, wherein the receptacle includes upper flaps having a plurality of eyelets;

a first connecting member, including a hollow head and first arm extending from the head;

a second connecting member, including a second arm and a tongue configured to fit into the hollow head; and wherein each of the first and second arms include an aperture: and a first securing mechanism for passing through the apertures in the first arm and an eyelet of the upper flaps and a second securing mechanism for passing through the apertures in the second arm and an eyelet of the upper flaps, for coupling the first arm and second arm to the receptacle;

wherein each securing mechanism further comprises:

a threaded member having a head, and a hollow threaded receptacle separable from the arm, the receptacle having a flange defining a generally flat surface which abuts relatively flush with the upper flap upon the securing mechanism coupling the arm to the foot apparel, capable of receiving the threaded member within the hollow receptacle.

11. A latching mechanism as claimed in claim 10, wherein the head further comprises side openings and wherein each prong member having a protrusion defining the side surface of the prong member, the protrusion being configured to align with and pass through the side apertures of the head to allow the prong members to spring back to the unflexed position upon the first and second prong members being inserted into the open interior of the head.

12. Foot apparel and a latch for use on a user's foot, comprising:

a receptacle for receiving the user's foot, wherein the receptacle includes upper flaps having a plurality of eyelets;

a first connecting member, including a hollow head and first arm extending from the head;

a second connecting member, including a second arm and a tongue configured to fit into the hollow head; and wherein each of the first and second arms include an aperture; and a first securing mechanism for passing through the apertures in the first arm and an eyelet of the upper flaps and a second securing mechanism for passing through the apertures in the second arm and an eyelet of the upper flaps, for coupling the first arm and second arm to the receptacle;

wherein the head further comprises an open end and an opposite end coupled to the first arm, the open end defining an open width; and wherein the second arm, further comprises:

a first and second prong members, each prong member having a first end coupled to the second arm and a second free end, wherein the prong members extend from the second arm with the second ends of the prong member spaced from each other in an unflexed position, the prong members being formed of a material having sufficient flexibility and resiliency to allow the free ends of the prong members to flex toward each other when urged together by an external force; and to spring back to the unflexed position when the external force is removed, each prong member having a side surface, the side surfaces of the prong members being spaced from each other by a distance greater than the opening width of the open end of the head upon the prong members being in the unflexed position, the side surfaces of the prong members being spaced from each other by a distance less than the opening width of the open end of the head upon the prong members being flexed toward each other, such that the prong members may be inserted into the open end of the head.

13. Foot apparel and a latch as claimed in claim 12, wherein the first arm extends at an angle adjacent the head.

14. Foot apparel and a latch as claimed in claim 12, wherein the second arm extends at an angle adjacent the prong members.

15. Foot apparel and a latch as claimed in claim 12, wherein each securing mechanism further comprises:

a threaded member having a head, and a hollow threaded receptacle separable from the arm, the receptacle having a flange defining a generally flat surface which abuts relatively flush with the upper flap upon the securing mechanism coupling the arm to the foot apparel, capable of receiving the threaded member within the hollow receptacle.

* * * * *